US006415110B1

(12) United States Patent
Kimura

(10) Patent No.: US 6,415,110 B1
(45) Date of Patent: Jul. 2, 2002

(54) IMAGE FORMING APPARATUS AND METHOD WITH AUTOMATIC SIZE AND ORIENTATION DETERMINATION

(75) Inventor: Hisashi Kimura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/641,336

(22) Filed: Aug. 18, 2000

(51) Int. Cl.[7] ..... G03G 15/00
(52) U.S. Cl. ..... 399/14; 399/81
(58) Field of Search ..... 399/14, 86, 370, 399/376, 389, 81, 82

(56) References Cited

U.S. PATENT DOCUMENTS

| | | | | | |
|---|---|---|---|---|---|
| 4,260,248 | A | * | 4/1981 | Murata et al. | 399/376 X |
| 4,666,289 | A | * | 5/1987 | Kawano | 399/14 |
| 4,682,877 | A | * | 7/1987 | Fujiwara et al. | 399/86 |
| 5,287,159 | A | * | 2/1994 | Sakakibara | 399/86 |
| 6,285,842 | B1 | * | 9/2001 | Katamoto et al. | 399/81 |

FOREIGN PATENT DOCUMENTS

JP 8-314334 11/1996

* cited by examiner

*Primary Examiner*—Joan Pendegrass
(74) *Attorney, Agent, or Firm*—Foley & Lardner

(57) ABSTRACT

The image formation apparatus according to the present invention has a document setting portion for setting a document, a size setting button for setting the size of a paper on which an image of the document is transferred by selecting it from a plurality of sizes, an automatic-operation key for instructing to automatically determine whether or not an orientation of the set document is the same as that of the image receipt body of a predetermined size, a detecting portion for detecting the orientation and size of the document set on the document setting portion on the instructions of automatic determination by the automatic-operation key, a determination portion for determining whether or not the orientations of the set document and the image receipt body are equal to each other, and whether the sizes of the set document and the image receipt body of a predetermined size are equal to each other, a display portion for displaying an operation procedure which should be performed by a user in accordance with the determination results from the determination means, and operation portion to be operated in accordance with the message displayed on the display portion.

8 Claims, 4 Drawing Sheets

IMAGE FORMING APPARATUS AND METHOD WITH AUTOMATIC SIZE AND ORIENTATION DETERMINATION

BACKGROUND OF THE INVENTION

The present invention relates to an image forming apparatus used as an electrophotographic copying machine.

The image forming apparatus of this type has been recently set up in convenience stores etc. Customers can use the image forming apparatus if they pay a fee.

When a copy is made, a user sets a document on a document setting table of the image forming apparatus and presses a copy button. By this operation, an image of the document set on the document setting table is transferred on a paper sheet and the paper sheet is discharged from the image forming apparatus.

In the convenience store, customers make copies without paying attention to orientation and size of a document and a paper sheet.

More specifically, even if an A4-size document is set on the document setting table, a copy is improperly made by setting a B5-size sheet or an A3-size sheet.

In particular, when a document of an indefinite-size is set on the document setting table, it is difficult to set a proper size of paper sheet and to align the document with the table. In this case, whether or not the copy is properly made, is discovered for the first time after the copy is actually made.

It follows that a number of wrong-copies are produced. As a result, extra time and trouble are required and the cost unnecessarily increases.

BRIEF SUMMARY OF THE INVENTION

An object of the present invention is to provide an image forming apparatus and an image forming method capable of easily making a suitable copy by automatically determining whether the orientation of the document set on a document setting portion is the same as an image recipient body of a predetermined size, and displaying a message of an operation procedure which should be performed by a user, based on how the size and orientation of the document compare to the size and orientation of the recipient body of a predetermined size.

According to one embodiment of the present invention, the aforementioned object is realized by an image forming apparatus comprising a document setting portion, a size determination means, to select the size of the recipient body from a plurality of sizes; and detecting means, to detect the size and orientation of the document. According to this embodiment, the image forming apparatus of the present invention further comprises, a determination means, to determine if the size and orientation of the document are the same as the size and orientation of the recipient body, display means, to display a message to the user of what operation procedure should be performed based on the comparison of the document to the recipient body, and operation means, to carry out the operation procedure selected from the display message by the user.

According to a preferred embodiment, an image forming apparatus comprises a document setting portion, a size determination means, to select the size of the recipient body; and detecting means, to detect the size and orientation of the document. According to this embodiment, the image forming apparatus of the present invention further comprises, a determination means, to determine if the size and orientation of the document are the same as the size and orientation of the recipient body, a first display means to display to display a message to the user of what operation procedure should be performed based on the comparison of the documents to the recipient body, a second display means to display an image of the size and orientation of the document and the size and orientation of the recipeint body, and operation means to carry out the operation procedure selected from the display message by the user.

According to another embodiment of this invention, the aforementioned object is realized by a method of of forming an image comprising setting a document, selecting the size of the image receipt body from a plurality of sizes, detecting the orientation and size of the document, determining whether the size and orientation of the document is the same as the size and orientation of the receipt body, displaying a message of an operating procedure which should be performed by a user, and operating the operating procedure as displayed in the display step.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, the present invention will be explained with reference to embodiments shown in the accompanying drawings.

Figure 1:
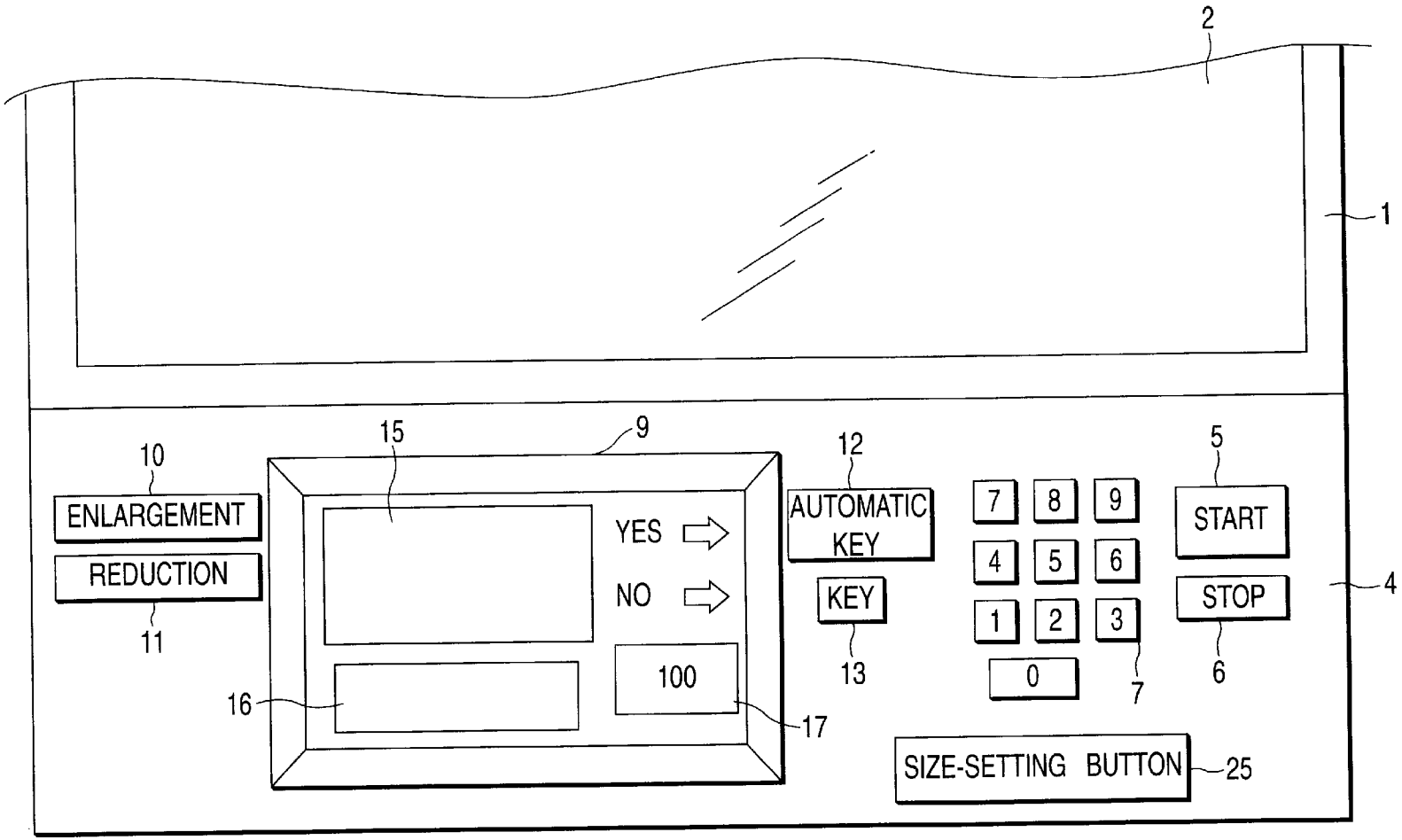
FIG. 1 is a plan view of an operation-control panel of an electrophotographic apparatus according to an embodiment of the present invention.

FIG. 1 is a plan view of an electrophotographic copying machine as the image forming apparatus according to an embodiment of the present invention.

In the figure, reference numeral 1 is a copy machine main body. In the upper portion of the copying machine main body 1, a document setting table 2 is provided. On the document setting table 2, an openable document cover (not shown) is placed. An operation-control panel 4 is provided in a front portion of the document setting table 2. At one-side portion of the operation-control panel 4, a copy button 5 for initiating a copying process, a stop button 6 for terminating the copying process, a ten-key 7 for setting the number of copies, and a size-setting button 25 as a size-setting means for setting the size of the paper sheets serving as the image receipt body.

A display portion 9 is provided at the other side portion of the operation-control panel 4. At one side portion of the display portion 9, an enlargement copy key 10 and a reduction (i.e. microcopy key 11 are arranged. At the other side portion, an automatic operation key 12 and a NO key 13 are arranged as the determination key.

At the display portion 9, a message display portion 16 is arranged as a first display means. The message display portion 16 displays an operation procedure to be performed by a user. At the behind of the message display portion 16, a copy-image display portion 15 is arranged as a second display means. The copy-image display portion 15 displays an image of sizes of a paper sheet of a predetermined size and a document set on the table. At one side of the message display portion 16, a magnification display portion 17 is provided for displaying a copy-magnification rate.

Figure 2:
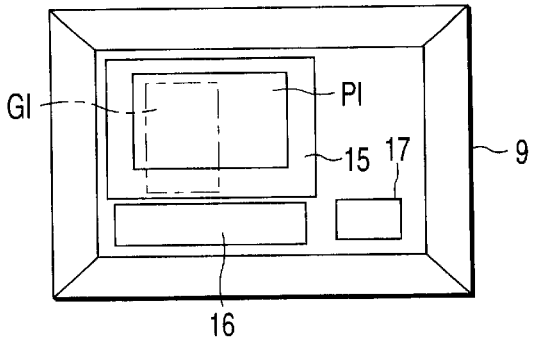
FIG. 2 is a plan view of a first display-example on a copy-image display portion of the operation-control panel.
Figure 3:
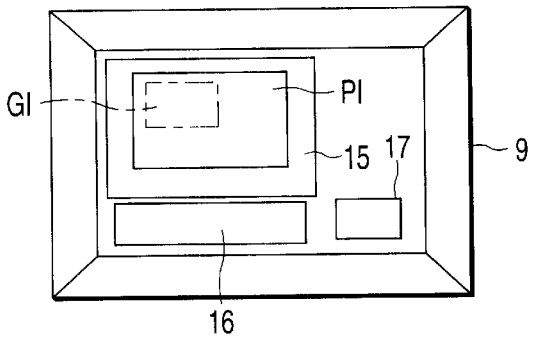
FIG. 3 is a plan view of a second display-example on a copy-image display portion of the operation-control panel.
Figure 4:
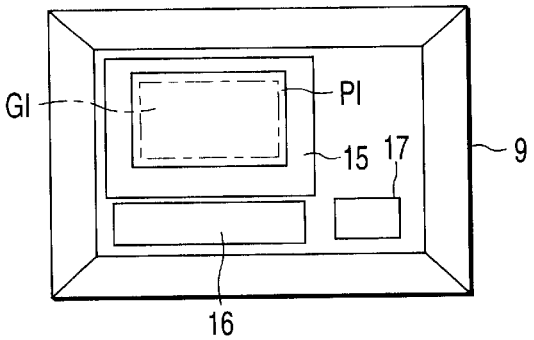
FIG. 4 is a plan view of a third display-example on a copy-image display portion of the operation-control panel.

FIGS. 2 to 4, each shows an image of sizes of a paper sheet PI and a document GI displayed on the copy-display portion 15.

FIG. 2 is an image of sizes of the document and the preset paper in the case where the document set on the document setting table 2 differs in orientation from a paper sheet of a predetermined size.

In this case, the message display portion 16 displays a message: (1) "The document differs from the paper in orientation. Please change the orientation of the paper"; (2) "The document will extend over the paper sheet if a regular copy is made. Do you want to make a microcopy?"; or (3) "Do you want to use a larger paper sheet?

FIG. 3 is an image of sizes of the document and the paper sheet of a predetermined size in the case where the document set on the document setting table 2 is smaller than the paper sheet set on the document setting table 2.

In this case, the message display portion 16 displays a message: (4) "Do you want to make an enlarged copy?"; or (5) "Do you want to use a smaller paper sheet".

FIG. 4 shows an image of sizes of the document and the paper sheet of a predetermined size set on the document setting table 2 in the case where the document and the paper sheet are equal in size.

In this case, the message display portion displays a message: (6) "A microcopy is made. Press the copy button"; (7) "An enlarged copy is made. Press the copy button"; or (8) A regular copy is made. Press the copy button.

Figure 5:
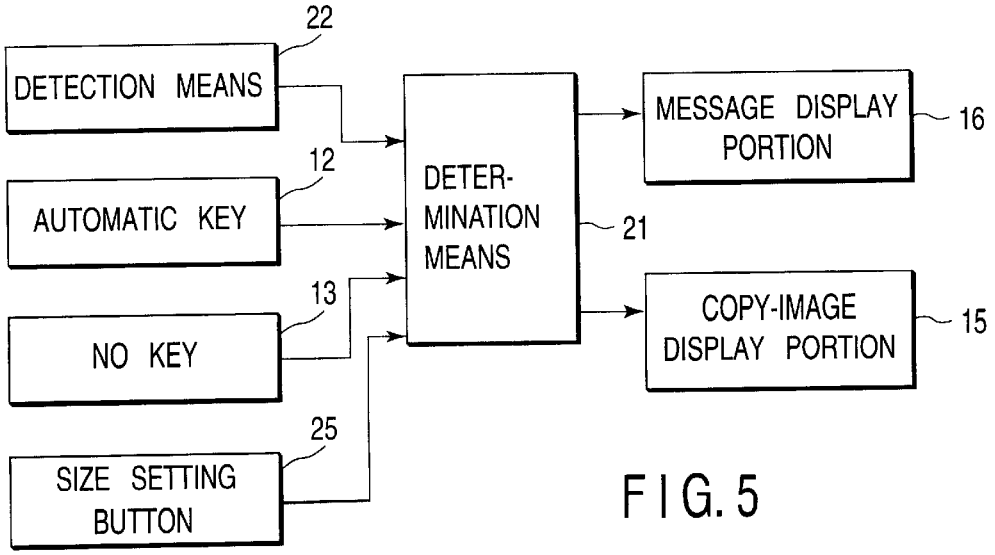
FIG. 5 is a block diagram showing how to connect an operation-control portion, determination portion and display portion.

FIG. 5 is a block diagram showing a structure of an operation-control section.

The automatic-operation key 12 and NO key 13 are connected to the determination means 21 by way of signal paths. To the determination means 21, the message display portion 16 and the copy-image display portion 15 are connected by way of a control circuit.

To the determination means 21, a detection means 22 and a size setting button 25 are connected by way of the signal paths. The detection means 22 detects the size of the document set on the document setting table 2 and the orientation of the longitudinal side of the document.

The detection means 21 displays the message of the operation procedure to be performed by a user on the message display portion 16, on the basis of the detection signal transmitted from the detection means 22 and the setting signal set by the size setting button 25, or on the basis of the operation signal transmitted from the automatic operation key 12 and NO key 13. At the same time, the detection means 21 allows the copy image display portion 15 to display an image of sizes of the paper PI and an image of the document GI.

Then, the operation to be carried out before the image forming operation is initiated, will be explained with reference to the flow charts of FIGS. 6–8.

First, a user sets a document on the document setting table 2 (Step S1). Then, when the user wishes to automatically determine the orientations of the set document and the paper sheet of a preset size, the user presses the automatic operation key 12 (Step S2). By the operation, the document size and the longitudinal orientation of the document can be detected by the detecting means 22 (Step S3). Thereafter, whether the longitudinal orientation of the document matches with that of the paper sheet of a predetermined size, is determined by the determination means 21 on the basis of the detection data transmitted from the detection means 22 (Step S4). If the orientations of the document and the sheet is determined the same, then, the dimensional relationship between them is determined by the determination means 21 (Step S5). If it is determined that the document has the same size as the paper sheet, the message "a regular copy is made. Press the copy button" is displayed on the message display portion 16 (Step S6). At this time, the copy-image display portion 15 displays an image of the sizes of the document G1 and the paper size P1 as shown in FIG. 4. An operator looks at these display messages and then presses the copy button 5. Then, the copy-making process is initiated (Step S7).

Further in the step S4, if it is determined by the determination means 22 that the longitudinal side of the set document is not the same as that of the paper of a predetermined size in orientation, the message display portion 16 displays "Document and paper sheet differ in orientation, please change orientation of the document" (Step S8). At this time, an image of sizes of the paper sheet P1 and. the document G1 is displayed on the copy-image display portion 15, as shown in FIG. 2.

A user determines whether the document is changed in orientation (Step 9). When the orientation of document is changed into the same orientation of the paper (Step S10), the process after Step S2 is carried out.

When the orientation of the document is not changed in Step S9, the automatic operation key 12 is pressed (Step S11) and the process after Step 12 (described later) is carried out.

On the other hand, in Step S5, if it is determined by the determination means 21 that the document is larger than the paper, the message display portion 16*a* displays the message "Document will extend over the paper if a regular copy is made. Do you want to make a microcopy?" (Step S12). When the reduction (i.e. microcopy) is made, an automatic key 12 is pressed (Step S13). As a result, the image of the document is automatically reduced (Step 14) and a reduction rate is displayed on the magnification display portion 17 (Step S15). At the same time, the display portion 16 displays the message "Microcopy is made. Press the copy button". When a user presses the copy button 5 in accordance with the display, copying process is initiated (Step S7).

Furthermore, in Step 5, if it is determined by the determination means 21 that the document is smaller than the paper sheet of a predetermined size, the message display portion 16 displays the message "Do you want to make an enlarged copy?" (Step S17). At this time, the image of sizes of the paper PI and the document GI is displayed on the copy-image display portion 15, as shown in FIG. 3. When the enlarged copy is made, the user presses the automatic operation key 12 (Step S18). By this operation, the image on the document is automatically enlarged (Step S19) and the magnification rate is displayed on the magnification display portion 17 (Step S20). The message "Enlarged copy is made. Press the copy button" is displayed on the image display portion 16 (Step S21). When a user presses the copy button 5 in accordance with the message on the display, a copying process is initiated (Step S7).

Figure 6:
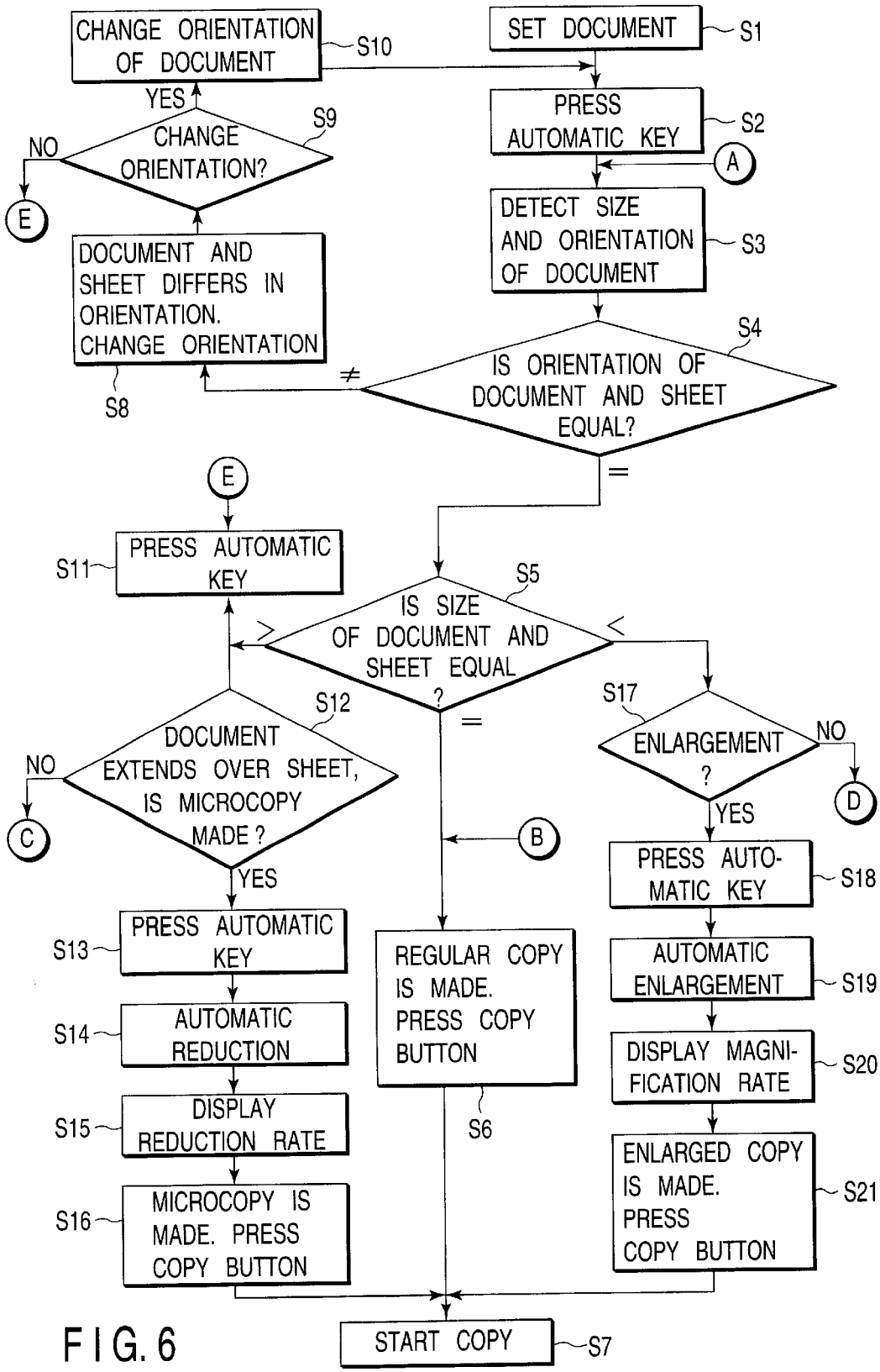
FIG. 6 is a flow chart showing operations before an image forming operation is initiated.
Figure 7:
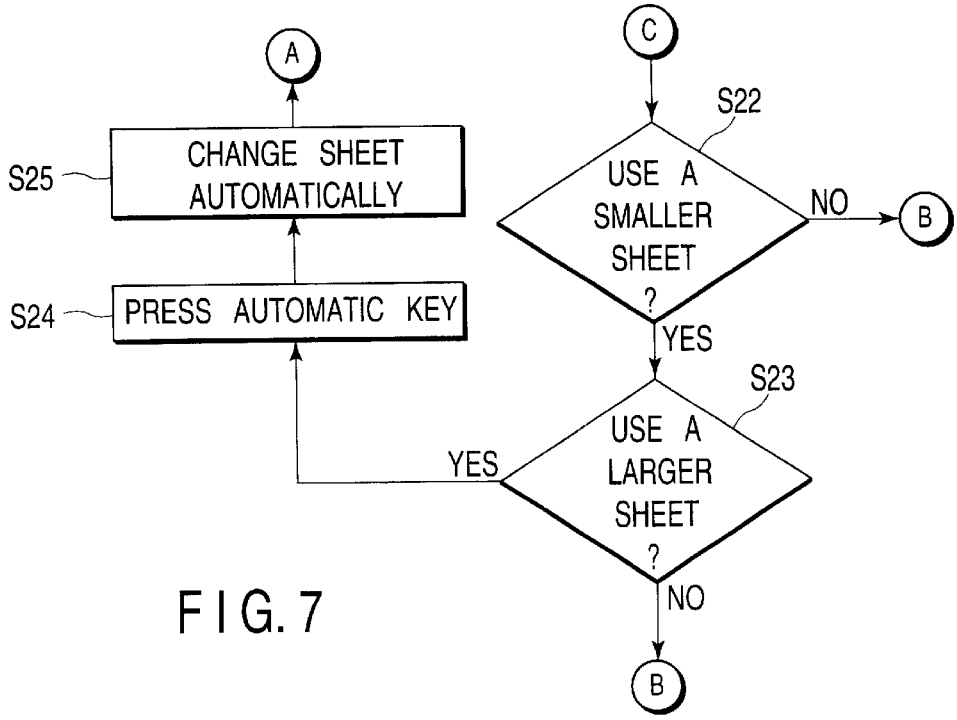
FIG. 7 is a flow chart showing operations before an image forming operation is initiated.

In Step 12, in the case where the reduction (i.e. microcopy) is not made, whether or not the preset paper is the smallest or not is determined as shown in FIG. 7 (Step S22). When it is determined that the paper size is the smallest, the message "Do you want to use a larger paper sheet?" is displayed on the image display portion 16 (Step S23). When an enlarged copy is not made, the NO key 13 is pressed. By this operation, the process after Step 6 shown in FIG. 6 is carried out.

In Step 23, when a larger paper sheet is used, the automatic operation key 12 is pressed (Step 24). By this operation, the paper sheet is automatically replaced with larger one (Step S25) and the process after step S3 shown in FIG. 6 is carried out.

Figure 8:
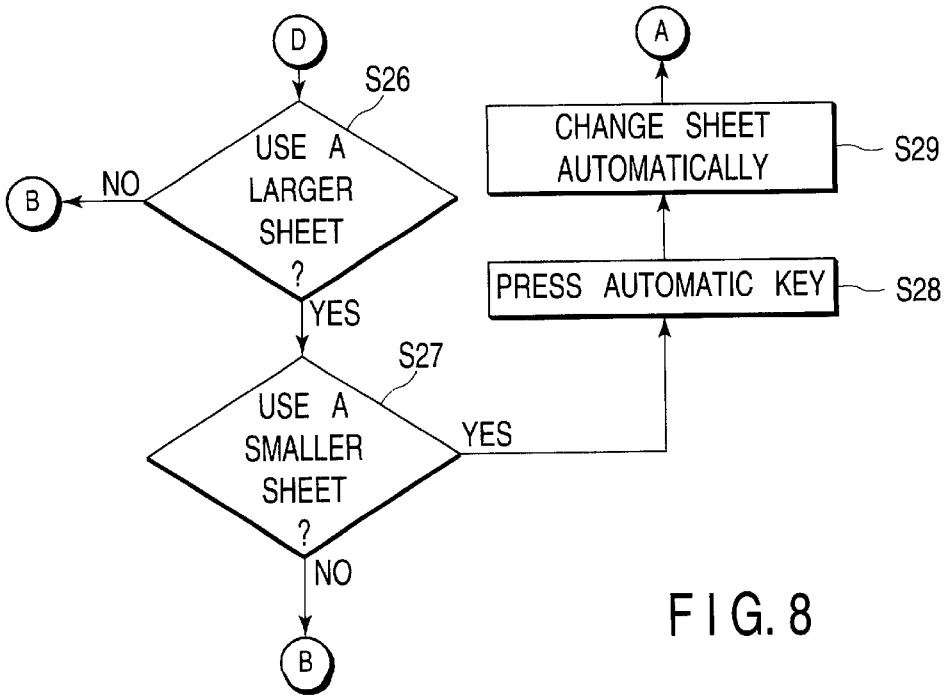
FIG. 8 is a flow chart showing operations before an image forming operation is initiated.

In Step S17 shown in FIG. 6, when the enlarged copy is not made, whether the paper size is the largest or not is determined (Step S26 in the FIG. 8). When the size is maximum, the message "Do you want to use a smaller paper one?" is displayed (Step S27). When a smaller paper is not used, the NO key is pressed. By this operation, the process after step S6 shown in FIG. 6 is carried out.

When the smaller paper sheet is used in Step S27, the automatic operation key 12 is pressed (Step S28). By this operation, the paper is automatically changed (Step S39) and the process after step S3 shown in FIG. 6 is carried out.

As described, according to the present invention, when the automatic key 12 is pressed, whether or not the document is set on the document setting table 2 in the same orientation as that of the paper of a preset size, is automatically determined. Then, the operation procedure which should be performed by a user is displayed on the message display portion 16 in accordance with the determination results. Simultaneously, the image of sizes of the document GI and the document PI is displayed on the copy-image display portion 15. Therefore, a desired copy can be made only by performing the operation in accordance with the message on the display.

Therefore, even if the document of an indefinite size is used, it is possible to make a desired copy securely by a single operation without making copies repeatedly several times. Therefore, extra time and trouble are required and the cost unnecessarily increases.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising a document setting portion on which a document is to be set;

size determination means for selecting a size of an image receipt body to which an image of the document is transferred, from a plurality of sizes;

detection means for detecting the orientation and size of the document set on the document setting;

determination means for determining whether or not the orientations of the set document and the image receipt body are equal to each other, and whether the sizes of the set document and the image receipt body of a predetermined size are equal to each other;

display means for displaying a plurality of operation procedure messages as a menu for selection by a user when the determination means determines that the sizes of the set document and the image-receipt body of a predetermined size are not equal to each other;

selecting means for allowing the user to select one of the plurality of operation procedure messages displayed by the display means; and operation means for performing an operation on the basis of the one of the operation procedure messages selected by the selecting means.

2. The image forming apparatus according to claim 1, wherein the plurality of operation procedure messages include:

a first message corresponding to "Do you want to make an enlarged copy of a microcopy";

a second message corresponding to "Do you want to select a one-size larger image-receipt body"; and a third message corresponding to "Do you want to select a one-size smaller image-receipt body".

3. An image forming apparatus comprising:

a document setting portion on which a document is to be set;

size determination means for selecting a size of an image receipt body to which an image of the document is transferred, from a plurality of sizes;

detection means for detecting the orientation and size of the document set on the document setting;

determination means for determining whether or not the orientations of the set document and the image receipt body are equal to each other, and whether the sizes of the set document and the image receipt body of a predetermined size are equal to each other;

display means for displaying a message of an operation procedure which should be performed by a user in accordance with the determination results from the determination means; and operation means for performing an operation on the basis of the message displayed on the display means, wherein the message displayed by the display means is "Do you want to make an enlarged copy?" or "Do you want to use a smaller image-receipt body?".

4. An image forming apparatus comprising:

a document setting portion on which the document is to be set;

size determination means for selecting a size of an image receipt body to which an image of the document is transferred, from a plurality of sizes;

detection means for detecting the orientation and size of the document set on the document setting portion;

determination means for determining whether or not the orientations of the set document and the image receipt body are equal to each other, and whether the sizes of the set document and the image receipt body of a predetermined size are equal to each other;

first display means for displaying a plurality of operation procedure messages as a menu for selection by a user when the determination means determines that the sizes of the set document and the image-receipt body of a predetermined size are not equal to each other;

second display means for displaying an image of sizes of the document and an image receipt body of a determined size;

selecting means for allowing the user to select one of the plurality of operation procedure messages displayed by the display means; and operation means for performing an operation on the basis of the one of the operation procedure messages selected by the selecting means.

5. The image forming apparatus according to claim 4 wherein the plurality of operation procedure messages include:

a first message corresponding to "Do you want to make can enlarged copy of a microcopy";

a second message corresponding to "Do you want to select a one-size larger image-receipt body"; and a third message corresponding to "Do you want to select a one-size smaller image-receipt body".

6. An image forming apparatus comprising:

a document setting portion on which the document is to be set;

size determination means for selecting a size of an image receipt body to which an image of the document is transferred, from a plurality of sizes;

detection means for detecting the orientation and size of the document set on the document setting portion;

determination means for determining whether or not the orientations of the set document and the image receipt body are equal to each other, and whether the sizes of the set document and the image receipt body of a predetermined size are equal to each other;

first display means for displaying a message of an operation procedure which should be performed by a user in accordance with the determination results from the determination means;

second display means for displaying an image of sizes of the document and the image receipt body of a determined size; and operation means for performing an operation on the basis of the messages displayed on the first and second display means, wherein the message displayed by the display means is "Do you want to make an enlarged copy?" or "Do you want to use a smaller image-receipt body?".

7. A method of forming an image, comprising:

a document setting step of setting a document;

a size determination step of selecting a size of the image-receipt body to which an image of the document is transferred, from a plurality of sizes;

a detection step of detecting the orientation and size of the document set on the document setting portion on the instructions of automatic determination in the instruction step;

a determination step of determining whether or not the orientations of the set document and the image receipt body are equal to each other, and whether the sizes of the set document and the image receipt body of a predetermined size are equal to each other;

a display step of displaying a plurality of operation procedure messages as a menu for selection by a user when the determination means determines that the sizes of the set document and the image-receipt body of a predetermined size are not equal to each other;

a selecting step of allowing the user to select one of the plurality of operation procedure messages displayed by the display step; and an operation step of performing an operation on the basis of the one of the operation procedure messages selected by the selecting step.

8. The method according to claim 7, wherein the plurality of operation procedure messages include:

a first message corresponding to "Do you want to make an enlarged copy of a microcopy";

a second message corresponding to "Do you want to select a one-size larger image-receipt body"; and a third message corresponding to "Do you want to select a one-size smaller image-receipt body".

* * * * *